US005533495A

United States Patent [19]

Moore, Jr.

[11] Patent Number: 5,533,495

[45] Date of Patent: Jul. 9, 1996

[54] BALANCED FLUE OUTDOOR WATER HEATER

[75] Inventor: H. Jack Moore, Jr., Johnson City, Tenn.

[73] Assignee: Southcorp Water Heaters USA, Inc., Johnson City, Tenn.

[21] Appl. No.: 395,759

[22] Filed: Feb. 28, 1995

[51] Int. Cl.[6] ..... F24H 1/00

[52] U.S. Cl. ..... 126/350 R; 126/361; 126/85 B; 122/19

[58] Field of Search ..... 126/360 R, 350 R, 126/344, 361, 391, 363, 389, 85 B, 307 R; 122/19, 264, 494, 14

[56] References Cited

U.S. PATENT DOCUMENTS

| | | | |
|---|---|---|---|
| 2,619,022 | 11/1952 | Hergenrother | 126/85 B |
| 3,091,223 | 5/1963 | Vitale . | |
| 3,172,403 | 3/1965 | Hanger et al. | 126/85 B |
| 5,020,512 | 6/1991 | Vago et al. . | |
| 5,146,911 | 9/1992 | Adams | 122/19 |

*Primary Examiner*—James C. Yeung
*Attorney, Agent, or Firm*—Miller & Christenbury

[57] ABSTRACT

An outside balanced flue water heater including a water tank, a jacket surrounding the water tank, a combustion chamber containing a burner positioned adjacent the water tank, a flue extending from the combustion chamber through an upper portion of the water tank, a water inlet and a water outlet connected to the water tank, a substantially airtight exterior shell positioned around the jacket and forming a combustion air passageway between the jacket and the exterior shell, the combustion air passageway communicating with the combustion chamber to supply combustion air from the combustion air passageway to the combustion chamber, a combustion air inlet chamber positioned on top of the water tank and adapted to directly receive outside air, the combustion air inlet chamber communicating with the combustion air passageway, and a flue gas exhaust chamber mounted on top of the combustion air inlet chamber and adapted to receive flue gases from the flue and to directly exhaust flue gases, the flue gas exhaust chamber communicating with the flue.

20 Claims, 3 Drawing Sheets

BALANCED FLUE OUTDOOR WATER HEATER

FIELD OF THE INVENTION

This invention relates to a gas-fired water heater, particularly to a gas-fired balanced flue water heater capable of installation and long term operation outdoors.

BACKGROUND OF THE INVENTION

Typical gas-fired water heaters are constructed for installation and operation in indoor spaces such as basements, laundry rooms and closets, for example. As a result, the materials selected for water heater components and construction of such water heaters do not lend themselves to installation and operation of water heaters outside of such buildings. Exterior operation subjects water heaters to the elements which can reduce water heater longevity and reduce operating efficiency.

There is a growing need for water heaters capable of exterior installation and operation in view of increasing regulation of placement and operation of water heaters in interior spaces. For example, many localities now have regulations concerning the need to supply combustion air from outside the structure instead of the traditional means of supplying combustion air from the interior space itself. A number of water heaters have been developed to address these problems, such as the water heater disclosed in U.S. Pat. No. 5,020,512. That water heater uses a first concentric tube to supply combustion air from outside of the building in which the water heater is located and a second concentric tube to exhaust combustion gases outwardly of the building. Combustion air is channeled from the outer concentric tube into an outer jacket surrounding the water heater, the outer jacket forming a space communicating with the combustion chamber of the water heater.

Such water heaters typically require cumbersome concentric or multiple tubing with the necessary associated boring or cutting through the wall of the structure and then mounting vents to the wall. This additional apparatus is expensive and sometimes not easy to install because of the distance to the wall or Obstacles between the wall and the water heater. Thus, exterior installation would be a possible alternative. However, such water heaters are constructed from materials suitable for indoor use which does not account for harsh exterior conditions likely to be encountered by an outdoor water heater.

Another problem necessitating water heaters for exterior installation and operation is the lack of suitable interior space for water heaters. Many dwellings are constructed without basements and, since space is at a premium, many dwellings seek to minimize or eliminate the space occupied by bulky water heaters. Multiunit dwellings are especially frequently space deficient and can benefit by exterior installation of water heaters. Also, since many dwellings are constructed without masonry chimneys, exhausting the hot flue gases can become a significant problem if the water heater is not designed to reduce flue gas temperatures.

Although many typical water heaters have been installed outside of living spaces, such as in garages, out buildings and the like, attempts to employ such water heaters completely outside have not been successful. The materials of construction of the water heaters lend themselves to premature corrosion of exterior parts. Installation of water heaters outside severely reduces energy efficiencies, especially in northern locations wherein combustion air often is very low in temperature and the entire unit is subjected to very severe low temperatures. Installation of water heaters outside can lead to reduced operating efficiencies because of the cold temperatures or because of excess wind blowing out pilot lights and accumulation of debris, such as leaves and the like around the base of the water heater, thereby reducing a balanced supply of combustion air to the water heater.

OBJECTS OF THE INVENTION

It is an object of the invention to provide a water heater capable of installation and operation outside for prolonged periods of time.

It is another object of the invention to provide a water heater capable of withstanding harsh exterior elements and operate in an energy efficient mode.

It is yet another object of the invention to provide a water heater suitable for exterior use that is self-contained without extraneous flue gas exhaust apparatus.

Other objects and advantages of the invention will become apparent to those skilled in the art from the drawings, the detailed description of the invention and the appended claims.

SUMMARY OF THE INVENTION

The water heater of the invention includes a tank, a jacket surrounding the tank, a combustion chamber containing a burner positioned adjacent the tank, a flue extending from the combustion chamber through an upper portion of the tank, a water inlet and a water outlet connected to the tank. The water heater also includes an exterior shell positioned around the jacket which forms a passageway between the jacket and the shell. The passageway extends to the combustion chamber to supply combustion air to the combustion chamber. A shell bottom pan connects to the exterior shell and forms a lower space communicating with the passageway. A shell top pan connects to the exterior shell and forms an upper space communicating with the passageway. A divider is spaced above the tank and the shell top pan and connects to a flue extension connected to the flue, which extends through a hole in the divider to form a combustion air inlet chamber. A cover is spaced above the divider and a cover holder connects between the cover pan and the divider. The cover, the divider and the holder form a flue gas exhaust chamber.

DETAILED DESCRIPTION OF THE INVENTION

Figure 1:
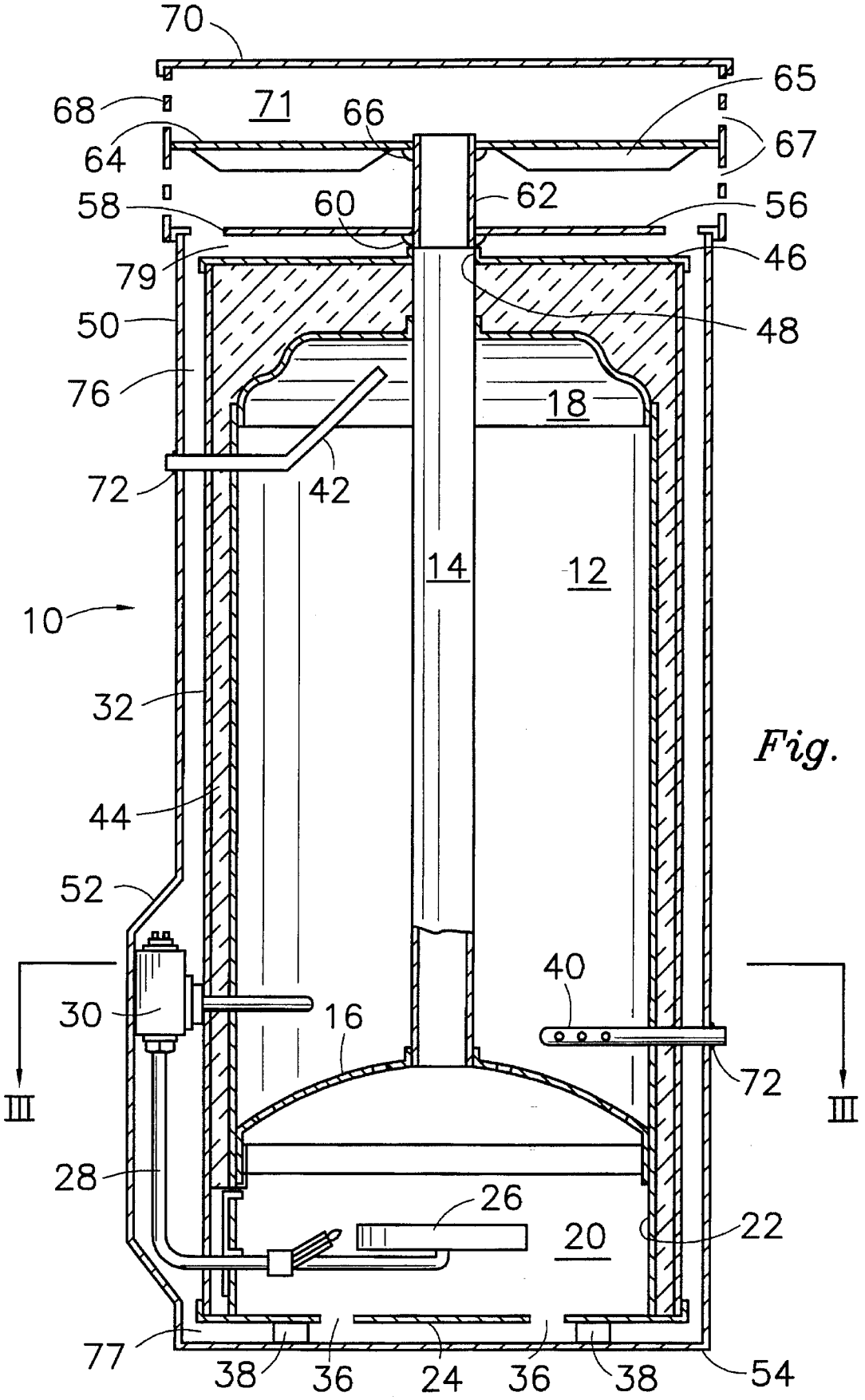
FIG. 1 shows a front elevational view, taken in section, of a water heater in accordance with aspects of the invention.

It will be appreciated that the following description is intended to refer to the specific embodiments of the invention selected for illustration in the drawings and is not intended to define or limit the invention, other than in the appended claims.

Figure 2:
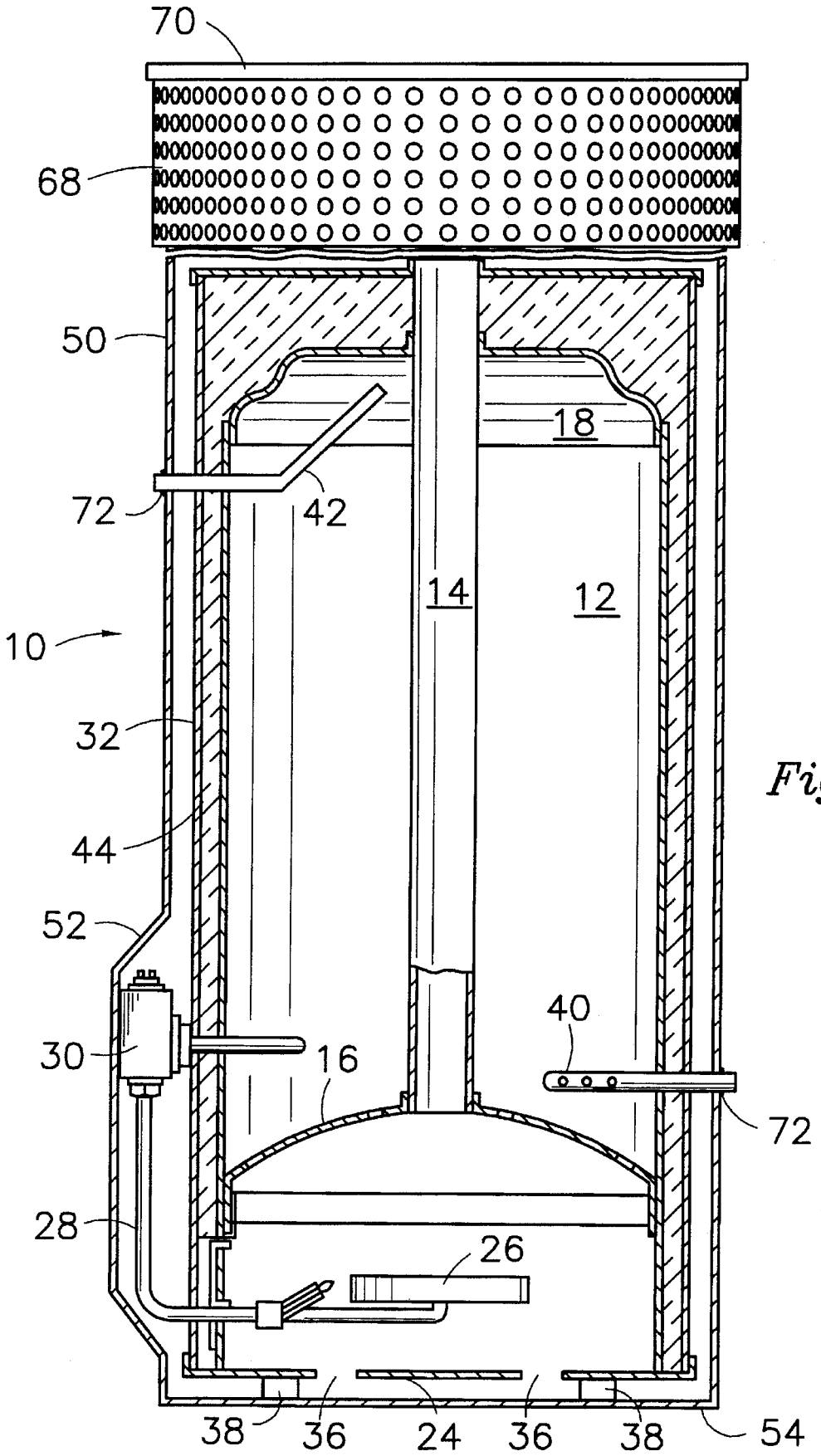
FIG. 2 shows the water heater of FIG. 1, taken partially in section, with the upper portion broken away for ease of understanding.

Turning now to the drawings in general, in FIGS. 1 and 2 in particular, the number 10 designates a balanced flue outdoor water heater of the invention. Water heater 10 is formed from a water tank 12 having a flue tube 14 extending between tank bottom 16 and tank head 18. A combustion chamber 20 is located beneath tank bottom 16 and formed from side wall 22 bottom pan 24 and tank bottom 16. A gas-fired burner 26 is located within combustion chamber 20 and connects to a fuel line 28 which connects to a controller 30. The controller 30 contains a thermostat and is mounted onto jacket 32 which connects to a sensor 34. Bottom pan 24 contains combustion air inlet holes 36 and has feet 38.

A top pan 46 connects to the upper portion of jacket 32 and contains opening 48 through which flue robe 14 extends. A water inlet 413 extends into a lower portion of tank 12 through jacket 32. Similarly, a water outlet 42 extends into an upper portion of tank 12 and outwardly of jacket 32. Foam insulation 44 is located between jacket 32 and tank 12. Foam insulation 44 is also located between top pan 46 and tank head 18.

Shell 50 is located concentrically outwardly of jacket 32 to form a passageway 76 and contains a sealed access door 52 which permits access to controller 30. Shell 50 is closed and substantially air tightly sealed on the bottom by a shell bottom pan 54 and on the top by a shell top pan 56. Bottom pan 24 and shell bottom pan 54 form a lower space 77 that communicates with passageway 76. In this preferred embodiment, lower space 77 is formed by the height of feet 38. Top part 46 and shell top pan 56 form an upper space 79 that communicates with passageway 76. Shell top pan 56 contains air inlet holes 58 and is sealed at seal 60 to flue extension 62. Divider plate 64, having a multiplicity of form stiffening ribs 65, is spaced above shell top pan 56 and is sealed at seal 66 to flue extension 62. It is to be appreciated that flue robe 14 can, of course, extend upwards to divider plate 64, removing the need for flue extension 62. Water inlet 40 and water outlet 42 are sealed to shell 50 by seals 72.

Perforated jacket 68 contains perforations 67 and connects to shell top pan 56, divider plate 64 and cover pan 70. Perforations 67 may preferably be round, or any geometric configuration. Shell top pan 56, divider plate 64 and perforated jacket 68 form a combustion air inlet chamber 69 which communicates with passageway 76 through air inlet holes 58 and with exterior air through perforations 67. Cover pan 70, divider plate 64 and perforated jacket 68 form a flue gas exhaust chamber 71 which receives flue gases from extension 62 and exhausts flue gases to the exterior air through perforations 67.

Figure 3:
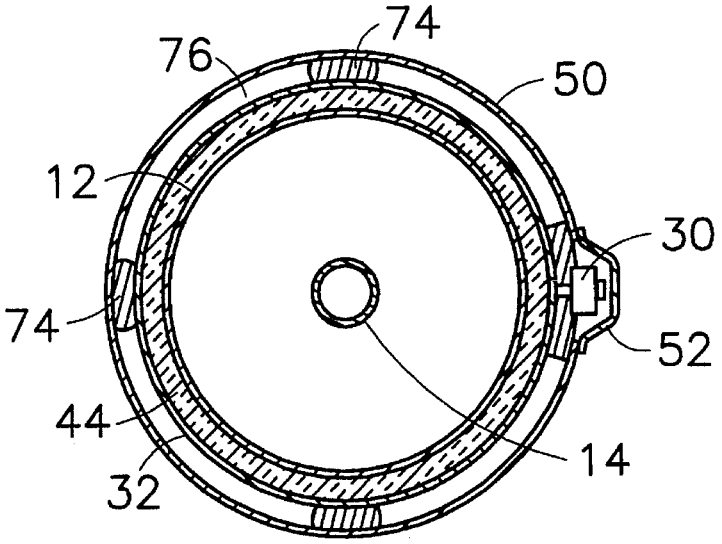
FIG. 3 shows a cross-sectional view of the water heater of FIG. 1 taken along the lines and arrows III—III.

FIG. 3 shows a cross-section of water heater 10 from FIGS. 1 and 2 wherein spacers 74 are located within passageway 76 to maintain shell 50 and jacket 32 in a desired concentric position.

Figure 4:
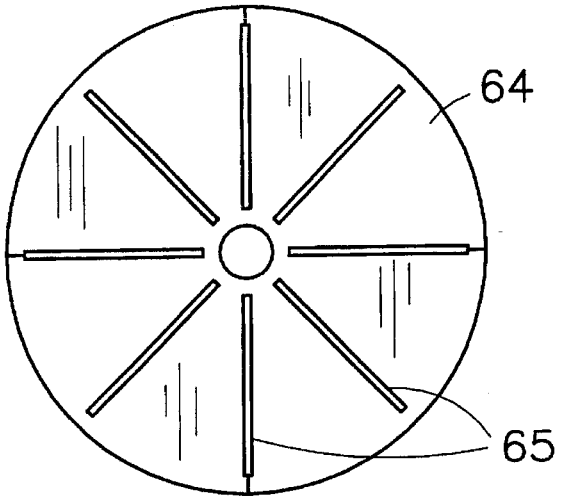
FIG. 4 shows a top plan view of a divider plate having form stiffening ribs in accordance with aspects of the invention.

FIG. 4 shows divider plate 64 from FIG. 1 having heat exchange ribs 65 extending radially outwardly along the surface of divider plate 64. Divider plate 64 is shown in a preferred configuration wherein four sections are combined to formed the entire divider plate 64.

Figure 5:
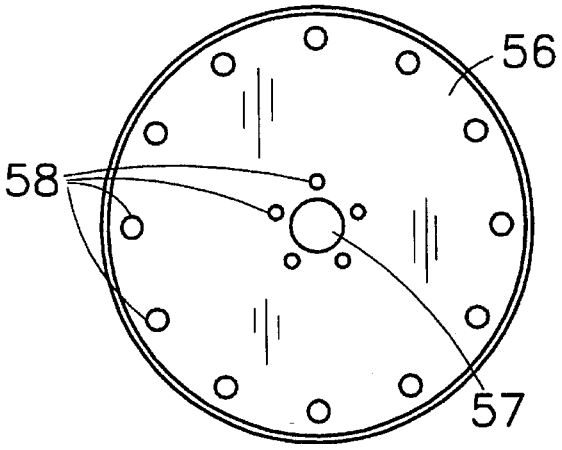
FIG. 5 shows a bottom plan view of a shell top pan having two sets of air inlet holes.

FIG. 5 shows shell top pan 56 having an opening 57 through which flue extension 62 passes. Shell top pan 56 also has two sets of air inlet holes 58. The first set is located adjacent opening 57 and is an alternate configuration. Air inlet holes 58 located around the exterior edge of shell top pan 56 are preferred.

Operation of the water heater of the invention will now be described below in connection with all of the drawings.

Withdrawal of hot water from water outlet 42 results in simultaneous introduction of cold water into tank 12 through water inlet 40. Sensor 34 detects temperature changes and controller 30 causes fuel to be supplied through fuel line 28 to burner 26. Ignition of fuel at burner 26 requires combustion air. Combustion air is supplied to combustion chamber 20 by way of perforations 67 in perforated jacket 68, combustion air inlet chamber 69, air inlet holes 58 in shell top pan 56 and into passageway 76 extending between shell 50 and jacket 32. Combustion air travels downwardly through passageway 76, past access door 52 and controller 30, into lower space 77 between shell bottom pan 54 and bottom pan 24 and into combustion chamber 20 by way of combustion air inlet holes 36. There is no need for separate or additional apparatus to conduct combustion air through a wall or other structure.

Combustion of fuel at burner 26 results in the production of flue gases, the flue gases moving upwardly into and through flue tube 14. The flue gases then continue upwardly and travel through flue extension 62 and into flue gas chamber 71. The flue gases then flow outwardly of flue gas chamber 71 to the outside air by way of perforations 67 in perforated jacket 68. There is no need for separate or additional apparatus to conduct flue gases through a wall or other structure. This system of introduction of combustion air and exhausting of flue gases from the top of water heater 10 results in a balanced flue water heater.

Heat exchange ribs 65 are heated by flue gases in flue gas chamber 71. This assists in equalizing the temperature between combustion air and flue gases. This benefit is especially present when air inlet holes 58 are located adjacent opening 57 in shell top pan 56 as shown in FIG. 5. In that case, incoming air combustion travels along the full length of heat exchange ribs 65 and has its temperature raised. It has been surprisingly discovered that water heater 10 of the invention is highly fuel efficient, despite the fact that incoming air, which at times is relatively very cold, travels along jacket 32. It was previously believed that such air travelling in passageway 76 would severely impair energy efficiency. Assistance of heat exchange ribs 65, coupled with use of foam insulation 44 eliminates possible energy inefficiencies. It has also been discovered that the flow of such air through passageway 76 is relatively very slow compared to exterior winds which are capable of causing severe heat loss. Passageway 76, lower space 77 and upper space 79 act as a type of insulation because of the relatively still air in those spaces. Retention of flue gases by cover pan 70 also helps water heater 10 retain heat at the top of the unit where the hottest water is located to thereby assist in heat retention.

Water heater 10 of the invention is fully capable of exterior use over long periods of time with a high degree of reliability. The lower portion of water heater 10 is sealed from the elements so that a continuous supply of moderate temperature combustion air is available without the possibility of obstruction or clogging due to accumulation of leaves, debris and the like.

Although this invention has been described in connection with specific forms thereof, it will be appreciated that a wide variety of equivalents may be substituted for the specific elements described herein without departing from the spirit and scope of this invention as described in the appended claims. For example, water tank 12 may be of any number of sizes and shapes and may be made from a wide variety of materials such as metals and/or plastics. Foam insulation 44 may similarly be made from any number of foam insulations well known in the art.

Shell 50 is preferably made from coated steel, although galvanized steel or other materials such as plastic may be employed so long as they are weather resistant. Similarly, cover pan 70, shell top pan 56 and shell bottom pan 54 may be made from coated steel, plastics or the like so long as they are weather resistant. Perforated jacket 68 is preferably made from stainless steel or powder painted metal and should be weather resistant. Perforated jacket 68 may be made with slits, slots or other shaped holes and may be made from alternate types of materials such as mesh, for example, so long as it is provided with means making it air and flue gas permeable in the desired locations. Divider plate 64 is preferably made from galvanized steel or other heat conductive material. Divider plate 64 may have any number of heat exchanging ribs 65, the ribs being formed from a wide variety of shapes and heat conducting materials.

The width of passageway 76 is not critical, although a one inch cavity is preferred. Spacers 74 may be made from a wide variety of materials, so long as they are stiff enough to retain jacket 32 in a substantially constant concentric position with respect to shell 50. Styrofoam blocks are especially preferred. Combustion air inlet chamber 69 and flue gas chamber 71 may have varied shapes and sizes as desired.

Burner 26 may be operated with a wide variety of fuels, including natural gas, propane, liquified natural gas, oil and the like. Any type of seals 72 may be used so long as they are capable of being substantially air tight. Flue extension 62 should be made from heat resistant material, preferably the same as flue tube 14, and may be connected to flue tube 14 by any known means such as by welding, screws, bolts and the like. Similarly, flue extension 62 may be sealed to divider plate 64 by any known means such as by welding, for example.

What is claimed is:

1. An outside balanced flue water heater comprising:

a water tank;

a jacket surrounding the water tank;

a combustion chamber containing a burner positioned adjacent said water tank;

a flue extending from said combustion chamber through an upper portion of said water tank;

a water inlet and a water outlet connected to said water tank;

a substantially airtight exterior shell positioned around said jacket and forming a combustion air passageway between said jacket and said exterior shell, said combustion air passageway communicating with said combustion chamber to supply combustion air from said combustion air passageway to said combustion chamber;

means forming a combustion air inlet chamber positioned on top of said water tank and adapted to directly receive outside air, said combustion air inlet chamber communicating with said combustion air passageway; and means forming a flue gas exhaust chamber positioned on top of said combustion air inlet chamber and adapted to receive flue gases from said flue and to directly exhaust flue gases, said flue gas exhaust chamber communicating with said flue.

2. The water heater defined in claim 1 further comprising a plurality of spacers located in said combustion air passageway to maintain said jacket and said exterior shell in a substantially constant position with respect to each other.

3. The water heater defined in claim 1 further comprising a sealable access door in said exterior shell positioned adjacent a controller mounted on said jacket in said combustion air passageway.

4. The water heater defined in claim 1 wherein the means forming said flue gas exhaust chamber is a cover pan spaced above said means forming a combustion air inlet chamber, and a flue gas permeable barrier positioned between said cover pan and said means forming a combustion air inlet.

5. The water heater defined in claim 1 wherein said means forming a combustion air inlet chamber contains a flue extension connected between said flue at the top of said water tank and said means forming a flue gas exhaust chamber.

6. The water heater defined in claim 1 wherein said means forming a combustion air inlet chamber contains a plurality of heat exchanging members positioned to receive heat from said flue gas exhaust chamber.

7. An outside water heater comprising:

a water tank;

a jacket surrounding the water tank;

a combustion chamber containing a burner positioned adjacent the water tank;

a flue extending from the combustion chamber through an upper portion of the water tank;

a water inlet and a water outlet connected to said water tank;

a substantially airtight exterior shell positioned around said jacket and forming a combustion air passageway between said jacket and said exterior shell, said combustion air passageway communicating with said combustion chamber to supply combustion air to said combustion chamber;

a divider, having a hole, spaced above said water tank to form a combustion air inlet chamber, said combustion air inlet chamber communicating with said combustion air passageway;

a flue extension, having an opening, connected to said flue and extending through said hole in said divider;

a cover spaced above said divider to form a flue gas exhaust chamber, said flue gas exhaust chamber communicating with said opening in said flue extension; and a cover holder connected to said cover to maintain said cover in spaced relationship with respect to said divider.

8. The water heater defined in claim 7 wherein said divider contains a plurality of spaced apart ribs.

9. The water heater defined in claim 8 wherein said divider is formed from four separate plates connected and substantially sealed together.

10. The water heater defined in claim 7 wherein said cover holder is a perforated substantially cylindrical jacket connected between said cover and said exterior shell.

11. The water heater defined in claim 7 further comprising a top pan connected to said exterior shell and forming an upper space above said water tank and the upper pan, the top pan having at least one air inlet hole to provide communication between said combustion air passageway and said combustion air inlet chamber.

12. The water heater defined in claim 11 wherein said top pan is circular and contains a multiplicity of air inlet holes directly above said upper space.

13. The water heater defined in claim 11 wherein said top pan is circular and contains a multiplicity of air inlet holes adjacent a central hole in said top pan through which said flue extension passes.

14. The water heater defined in claim 7 further comprising a bottom pan connected to said exterior shell and forming a lower space between said bottom pan and said combustion chamber, said lower space communicating with said combustion air passageway.

15. The water heater defined in claim 7 wherein said flue extension is sealed to said divider.

16. The water heater defined in claim 7 further comprising foam insulation positioned between said water tank and said jacket.

17. A water heater comprising:

a water tank having a water inlet and a water outlet and a flue extending from the bottom of said water tank to the top of said water tank;

an inner jacket surrounding said water tank and positioned to form an inner space around said water tank;

foam insulation positioned in said inner space;

a combustion chamber containing a burner formed by the bottom of said water tank, a side wall and a bottom pan, said combustion chamber being connected to said flue;

an inner top pan connected to said inner jacket and having a port through which said flue passes;

an outer jacket surrounding said inner jacket and said bottom pan and positioned to form an outer space between said outer and inner jackets and said outer jacket and said bottom pan;

an intermediate top pan connected to said outer jacket and having a port through which said flue passes, said intermediate top pan also having at least one air port communicating with said outer space;

a divider plate having a port through which said flue passes spaced above said intermediate top pan and forming a combustion air inlet chamber;

an upper top pan spaced above said divider plate and forming an exhaust gas outlet chamber; and a perforated cylinder connected between said intermediate top pan and said upper top pan.

18. An outside balanced flue water heater comprising:

a water tank;

a jacket surrounding the water tank;

a combustion chamber containing a burner positioned adjacent said water tank;

a flue extending from said combustion chamber through an upper portion of said water tank;

a water inlet and a water outlet connected to said water tank;

a substantially airtight exterior shell positioned around said jacket and forming a combustion air passageway between said jacket and said exterior shell, said combustion air passageway communicating with said combustion chamber to supply combustion air from said combustion air passageway to said combustion chamber;

means forming a combustion air inlet chamber comprising a divider space above said water tank and a combustion air permeable barrier positioned between said divider and said exterior shell, said combustion air inlet chamber adapted to directly receive outside air and communicating with said combustion air passageway; and means forming a flue gas exhaust chamber above said combustion air inlet chamber and adapted to receive flue gases from said flue and to directly exhaust flue gases, said flue gas exhaust chamber communicating with said flue.

19. An outside balanced flue water heater comprising:

a water tank;

a jacket surrounding the water tank;

a combustion chamber containing a burner positioned adjacent said water tank;

a flue extending from said combustion chamber through an upper portion of said water tank;

a water inlet and a water outlet connected to said water tank;

a substantially airtight exterior shell positioned around said jacket and forming a combustion air passageway between said jacket and said exterior shell, said combustion air passageway communicating with said combustion chamber to supply combustion air from said combustion air passageway to said combustion chamber;

means forming a combustion air inlet chamber above said water tank and adapted to directly receive outside air, said combustion air inlet chamber communicating with said combustion air passageway;

means forming a flue gas exhaust chamber above said combustion air inlet chamber and adapted to receive flue gases from said flue and to directly exhaust flue gases, said flue gas exhaust chamber communicating with said flue; and a shell top having at least one combustion air inlet hole connected to a top portion of the shell and forming a space between the top of said water tank and said combustion air inlet chamber, said space being connected to said combustion air passageway and said combustion air inlet hole providing for flow of combustion air from said combustion air inlet chamber to said space.

20. An outside water heater comprising:

a water tank;

a jacket surrounding the water tank;

a combustion chamber containing a burner positioned adjacent the water tank;

a flue extending from the combustion chamber through an upper portion of the water tank;

a water inlet and a water outlet connected to said water tank;

a substantially airtight exterior shell positioned around said jacket and forming a combustion air passageway between said jacket and said exterior shell, said combustion air passageway communicating with said combustion chamber to supply combustion air to said combustion chamber;

a divider, having a hole, spaced above said water tank to form a combustion air inlet chamber, said combustion air inlet chamber communicating with said combustion air passageway;

a cover spaced above said divider to form a flue gas exhaust chamber, said flue gas exhaust chamber communicating with said flue; and a cover holder connected to said cover to maintain said cover in spaced relationship with respect to said divider.

* * * * *